US009482224B2

(12) United States Patent
Naiki

(10) Patent No.: US 9,482,224 B2
(45) Date of Patent: Nov. 1, 2016

(54) OIL PUMP

(71) Applicant: MIKUNI CORPORATION, Tokyo (JP)

(72) Inventor: Takehiko Naiki, Iwate (JP)

(73) Assignee: MIKUNI CORPORATION, Tokyo (JP)

( * ) Notice: Subject to any disclaimer, the term of this patent is extended or adjusted under 35 U.S.C. 154(b) by 75 days.

(21) Appl. No.: 14/378,201

(22) PCT Filed: Jan. 29, 2013

(86) PCT No.: PCT/JP2013/051819
§ 371 (c)(1),
(2) Date: Aug. 12, 2014

(87) PCT Pub. No.: WO2013/125302
PCT Pub. Date: Aug. 29, 2013

(65) Prior Publication Data

US 2015/0017049 A1 Jan. 15, 2015

(30) Foreign Application Priority Data

Feb. 21, 2012 (JP) ..... 2012-034842

(51) Int. Cl.
*F03C 2/00* (2006.01)
*F03C 4/00* (2006.01)
(Continued)

(52) U.S. Cl.
CPC ..... *F04C 2/16* (2013.01); *F01C 21/106* (2013.01); *F01C 21/108* (2013.01); *F04C 2/102* (2013.01);
(Continued)

(58) Field of Classification Search
CPC ..... F04C 2/102; F04C 2/16; F04C 2/086; F04C 11/001; F04C 15/0026; F04C 15/06; F04C 14/02; F04C 2270/17; F01C 21/106; F01C 21/108; F01C 19/005; F05C 2251/044
USPC ..... 418/132, 149, 166, 171, 178–179, 9
See application file for complete search history.

(56) References Cited

U.S. PATENT DOCUMENTS 4,253,803 A * 3/1981 Wormmeester ..... F04C 14/265 417/283
4,540,347 A * 9/1985 Child ..... F04C 2/102 418/171
7,410,349 B2 * 8/2008 Ronk ..... F04C 2/102 418/171

FOREIGN PATENT DOCUMENTS

JP 63-186984 11/1988
JP 1-61477 4/1989
(Continued)

OTHER PUBLICATIONS

International Search Report issued Apr. 16, 2013 in International Application No. PCT/JP2013/051819.

*Primary Examiner* — Theresa Trieu
(74) *Attorney, Agent, or Firm* — Wenderoth, Lind & Ponack, L.L.P.

(57) ABSTRACT

An oil pump includes a housing (10, 20), a rotary shaft (30) which is supported by the housing, an inner rotor (71, 81) which is rotated in the housing integrally with the rotary shaft, an outer rotor (72, 82) which is rotated in the housing as being interlocked with the inner rotor, a rotor case (40) which is fitted into the housing and which contains the inner rotor and the outer rotor and supports an outer circumferential face of the outer rotor in a slidable manner, a side plate (50) which is arranged to be in contact with at least one annular end face of the rotor case, and an elastic member (60) which exerts an urging force to press the side plate to the annular end face of the rotor case. According to the above, slide resistance and operational torque can be reduced and constant side clearance can be maintained.

7 Claims, 16 Drawing Sheets

(51) Int. Cl.

| | |
|---|---|
| ***F04C 2/00*** | (2006.01) |
| ***F04C 2/16*** | (2006.01) |
| ***F01C 21/10*** | (2006.01) |
| ***F04C 2/10*** | (2006.01) |
| ***F04C 11/00*** | (2006.01) |
| ***F04C 15/00*** | (2006.01) |
| *F04C 14/02* | (2006.01) |
| *F04C 15/06* | (2006.01) |
| *F01C 19/00* | (2006.01) |

(52) U.S. Cl.
CPC ..... *F04C 11/001* (2013.01); *F04C 15/0026* (2013.01); *F01C 19/005* (2013.01); *F04C 14/02* (2013.01); *F04C 15/06* (2013.01); *F04C 2270/17* (2013.01); *F05C 2251/044* (2013.01)

(56) References Cited

FOREIGN PATENT DOCUMENTS

| | | |
|---|---|---|
| JP | 5-89881 | 12/1993 |
| JP | 6-323261 | 11/1994 |
| JP | 7-247964 | 9/1995 |
| JP | 8-42418 | 2/1996 |
| JP | 11-50972 | 2/1999 |
| JP | 11-343982 | 12/1999 |
| JP | 2006-125239 | 5/2006 |

* cited by examiner

OIL PUMP

TECHNICAL FIELD

The present invention relates to an oil pump which sucks and discharges oil (lubricant oil) of an internal combustion engine (an engine) or the like, and in particular, relates to a trochoid type oil pump including an inner rotor and an outer rotor.

BACKGROUND ART

There has been known a trochoid type oil pump including a housing (gear case), an outer rotor which has internal teeth as being rotatably arranged in the housing, an inner rotor which has external teeth engaged with the internal teeth of the outer rotor and which defines a volume-varying pump chamber in cooperation with the outer rotor, a rotary shaft which is rotatably supported by the housing to rotate the inner rotor, two side plates which are capable of being in contact with both side faces of the inner rotor and the outer rotor in the axis line direction of the rotary shaft and being moved in the axis line direction with slight clearance formed in the axis line direction, two elastic members which are arranged in the housing to press the two side plates toward both the side faces of the inner rotor and the outer rotor, and the like. Here, even in a case that dimensional variation in the axis line direction occurs at the housing, the inner rotor, and the outer rotor with thermal expansion and the like, the elastic members continuously press the two side plates respectively to both side faces of the inner rotor and the outer rotor. Accordingly, stable volume efficiency can be obtained without causing clearance (for example, see Patent Literature 1).

The abovementioned oil pump adopts a structure that the two non-rotatable side plates are pressed directly to the rotating inner rotor and outer rotor. Therefore, slide resistance becomes large, so that large rotational torque is required to operate the oil pump. Consequently, operational load of an engine or the like is increased.

Further, the two side plates are relatively slid in a state of being continuously pressed to both the side faces of the inner rotor and the outer rotor at predetermined pressure. Therefore, in a case that the side plates are made of softer material than that of the inner rotor and the outer rotor, wear, deterioration with time, and the like are more likely to occur to cause a problem in durability.

CITED LITERATURE

Patent Literature

Patent Literature 1: Japanese Utility-model Application No. 62-156057 (Japanese Utility-model Application Laid-open 1-61477) (Microfilm)

SUMMARY OF THE INVENTION

To address the above issues, an object of the present invention is to provide a durable oil pump whose volume efficiency (pumping performance) can be stabilized as preventing variation of side clearance at both the side faces of the inner rotor and the outer rotor while achieving reduction of slide resistance, reduction of operational torque, suppression of deterioration with time, and the like.

An oil pump according to the present invention includes a housing, a rotary shaft which is supported by the housing, an inner rotor which is rotated in the housing integrally with the rotary shaft, an outer rotor which is rotated in the housing as being interlocked with the inner rotor, a rotor case which is fitted into the housing and which contains the inner rotor and the outer rotor and supports an outer circumferential face of the outer rotor in a slidable manner, a side plate which is arranged to be in contact with at least one annular end face of the rotor case, and an elastic member which exerts an urging force to press the side plate to the annular end face of the rotor case.

According to the configuration, when the inner rotor is rotated along with the rotary shaft, (the outer circumferential face of) the outer rotor with which the inner rotor is in contact is rotated as being interlocked therewith to be slid on (the inner circumferential face of) the rotor case. Subsequently, oil is sucked (from an inlet port) and pressurized due to pumping action of both, and then, is discharged (from a discharge port) and fed toward various lubrication areas.

Here, the rotor case is fitted into the housing, the inner rotor and the outer rotor are arranged to be rotated in the rotor case, and the side plate is in contact with at least one annular end face of the rotor case as being urged by the elastic member in the axis line direction of the rotary shaft. Accordingly, for example, even in a case that the housing is thermally expanded, the rotor case is continuously in a state of being sandwiched between (the inner wall face at one side of) the housing and the side plate owing to the urging force of the elastic member. Therefore, both side faces of the inner rotor and the outer rotor can maintain constant clearance (side clearance) enabling to be slid between (the inner wall face at one side of) the housing and the side plate. In addition, oil leakage through the clearance can be prevented from occurring and stable volume efficiency (pumping performance) can be obtained. Further, since the urging force of the elastic member is not applied to both the side faces of the inner rotor and the outer rotor, slide resistance and operational torque can be reduced and durability can be improved compared to a conventional oil pump.

In the above configuration, it is possible to adopt a configuration that the rotor case is made of material having the same thermal expansion coefficient as that of the inner rotor and the outer rotor.

According to the configuration, even in a case that the housing, the rotor case, the inner rotor, and the outer rotor are deformed with thermal expansion and the like respectively, relative dimensional relations among the rotor case, the inner rotor, and the outer rotor can be maintained at constant. Accordingly, it is possible to maintain desired pumping performance more reliably without being influenced by thermal expansion and the like.

In the above configuration, it is possible to adopt a configuration that the side plate is made of material having the same thermal expansion coefficient as that of the housing.

According to the configuration, even when the same thermal deformation (thermal expansion) occurs at the side plate and the housing, contact relations among both the side faces of the inner rotor and the outer rotor, (the inner wall face of) the housing, and the side plate can be maintained in a desired state owing to that the side plate is urged by the elastic member in the axis line direction. In particular, when the housing and the side plate are made of light weight material or the like, there is an advantage that desired pumping performance can be maintained while achieving reduction in weight.

In the above configuration, it is possible to adopt a configuration that "Wc>Wr" is satisfied while Wc denotes a width dimension of the rotor case in the axis line direction of the rotary shaft and Wr denotes a width dimension of the inner rotor and the outer rotor in the axis line direction of the rotary shaft.

According to the configuration, both the side faces of the inner rotor and the outer rotor are maintained as being faced to (the inner wall face of) the housing and the side plate with constant clearance ΔC (=Wc−Wr) formed therebetween in a state of not being protruded from both ends (annular end faces at both sides) of the rotor case in the axis line direction. Accordingly, it is possible to ensure desired pumping performance while further reducing slide resistance.

In the above configuration, it is possible to adopt a configuration that the housing includes a housing body which has a concave portion to contain the rotor case and the side plate, and a housing cover which is coupled to close opening of the housing body.

According to the configuration, the entire assembling can be performed only by arranging the rotor case which contains the inner rotor and the outer rotor, the side plate, and the elastic member in the housing body and attaching the housing cover thereonto. Thus, assembling operation can be easily performed.

In the above configuration, it is possible to adopt a configuration that the inner rotor and the outer rotor include an upstream rotor including a first inner rotor and a first outer rotor and a downstream rotor including a second inner rotor and a second outer rotor, the upstream rotor and the downstream rotor being arranged adjacently in the axis line direction of the rotary shaft; and the rotor case includes an upstream accommodation portion which contains the upstream rotor, a downstream accommodation portion which contains the downstream rotor, and a middle wall portion which is interposed between the upstream accommodation portion and the downstream accommodation portion.

The configuration provides a two-stage trochoid pump in which the upstream rotor is arranged in the upstream accommodation portion and the downstream rotor is arranged in the downstream accommodation portion. Accordingly, as described above, while maintaining clearance (side clearance) at constant in the axis line direction, a desired discharge rate is ensured and enhanced pumping performance can be obtained as reducing a discharge resistance at high load, that is, as suppressing decrease in final discharge pressure.

Here, since the upstream accommodation portion, the downstream accommodation portion, and the middle wall portion are integrally formed in the rotor case, parts count can be reduced and handling convenience can be improved.

In the above configuration, it is possible to adopt a configuration that the inner rotor and the outer rotor include an upstream rotor including a first inner rotor and a first outer rotor and a downstream rotor including a second inner rotor and a second outer rotor, the upstream rotor and the downstream rotor being arranged adjacently in the axis line direction of the rotary shaft; the rotor case includes an upstream rotor case which contains the upstream rotor and a downstream rotor case Which contains the downstream rotor; and a spacer member is arranged between the upstream rotor case and the downstream rotor case.

The configuration provides a two-stage trochoid pump in which the upstream rotor is arranged in the upstream rotor case, the downstream rotor is arranged in the downstream rotor case, and the spacer member defines a space between the upstream rotor and the downstream rotor. Accordingly, as described above, while maintaining clearance (side clearance) at constant in the axis line direction, a desired discharge rate is ensured and enhanced pumping performance can be obtained as reducing a discharge resistance at high load, that is, as suppressing decrease in final discharge pressure.

Here, since the rotor case includes the upstream rotor case and the downstream rotor case and the separated spacer member is interposed therebetween, clearance at both side faces of the upstream rotor and clearance at both side faces of the downstream rotor can be maintained at constant independently with a high degree of accuracy.

In the above configuration, it is possible to adopt a configuration that the spacer member is made of material having the same thermal expansion coefficient as that of the housing.

According to the configuration, even when the same thermal deformation (thermal expansion) occurs at the spacer member and the housing, the spacer member is sandwiched between the upstream rotor case and the downstream rotor case via the elastically-urged side plate and (the inner wall face of) the housing. Accordingly, contact relations among both the side faces of the upstream rotor and the downstream rotor, (the inner wall face of) the housing, the spacer member, and the side plate can be maintained in a desired state. In particular, when the housing and the spacer member are made of light weight material or the like, there is an advantage that desired pumping performance can be maintained while achieving reduction in weight.

According to an oil pump having the abovementioned structure, while achieving reduction of slide resistance, reduction of operational torque, suppression of deterioration with time, and the like, volume efficiency (pumping performance) can be stabilized and durability can be improved as preventing variation of side clearance at both the side faces of the inner rotor and the outer rotor.

EMBODIMENT OF THE INVENTION

In the following, embodiments of the present invention will be described with reference to the attached drawings.

Figure 1:
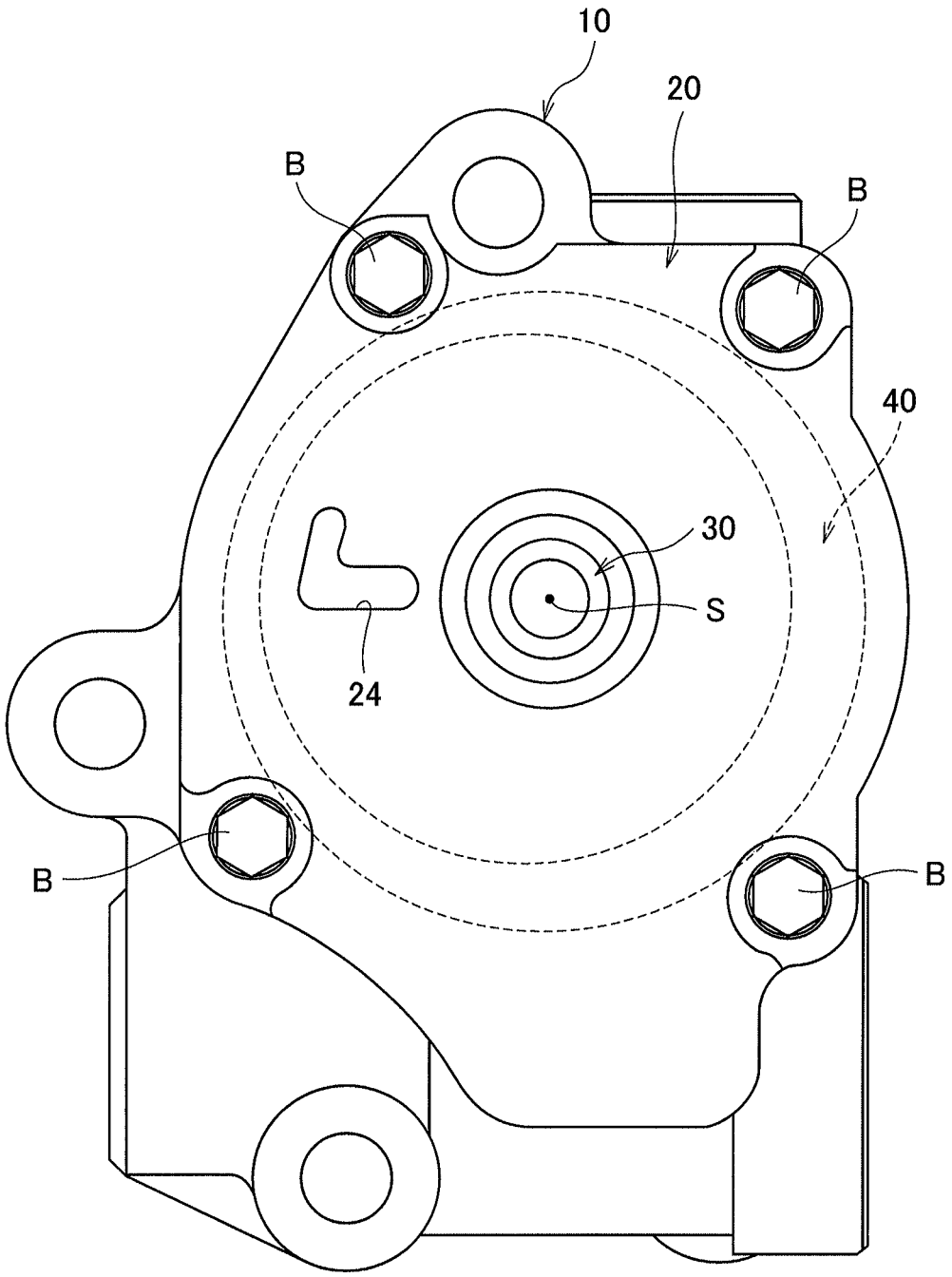
FIG. 1 is a front view illustrating an embodiment of an oil pump according to the present invention.
Figure 2:
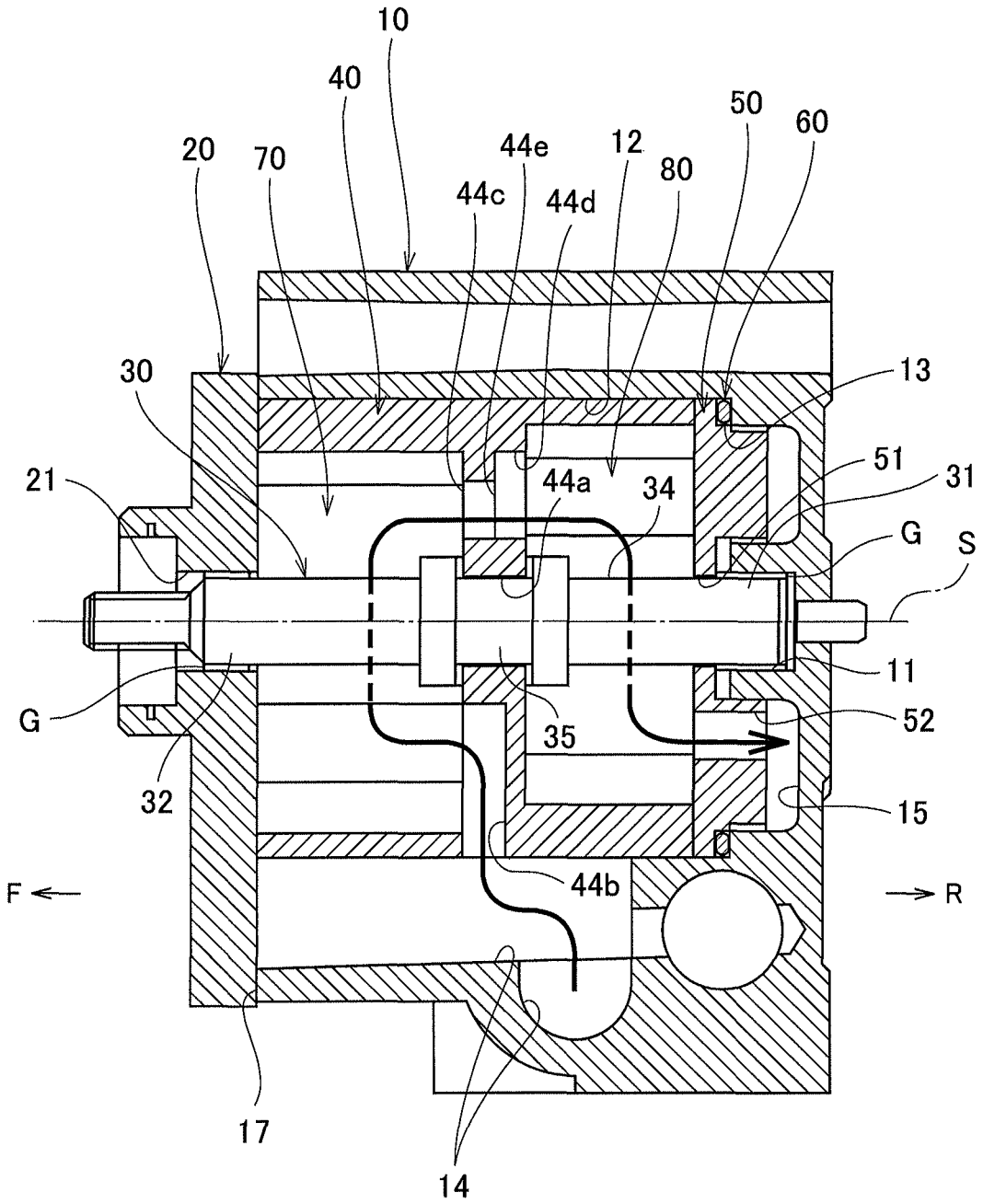
FIG. 2 is a sectional view illustrating the inside of the oil pump illustrated in FIG. 1.

As illustrated in FIGS. 1 and 2, an oil pump of the present embodiment includes a housing body 10 and a housing cover 20 which constitute a housing, a rotary shaft 30 which is supported by the housing as being rotatable about an axis line S, a rotor case 40 which is assembled in the housing, a side plate 50 which is in contact with an annular end face of the rotor case 40, an O-ring 60 as an elastic member which urges the side plate 50 to be pressed to the annular end face of the rotor case 40 in the direction of the axis line S, an upstream rotor 70, including a first inner rotor 71 and a first outer rotor 72, which is contained in the rotor case 40, a downstream rotor 80, including a second inner rotor 81 and a second outer rotor 82, which is contained in the rotor case 40 as being adjacent to the upstream rotor 70 in the direction of the axis line S, and the like.

Figure 3:
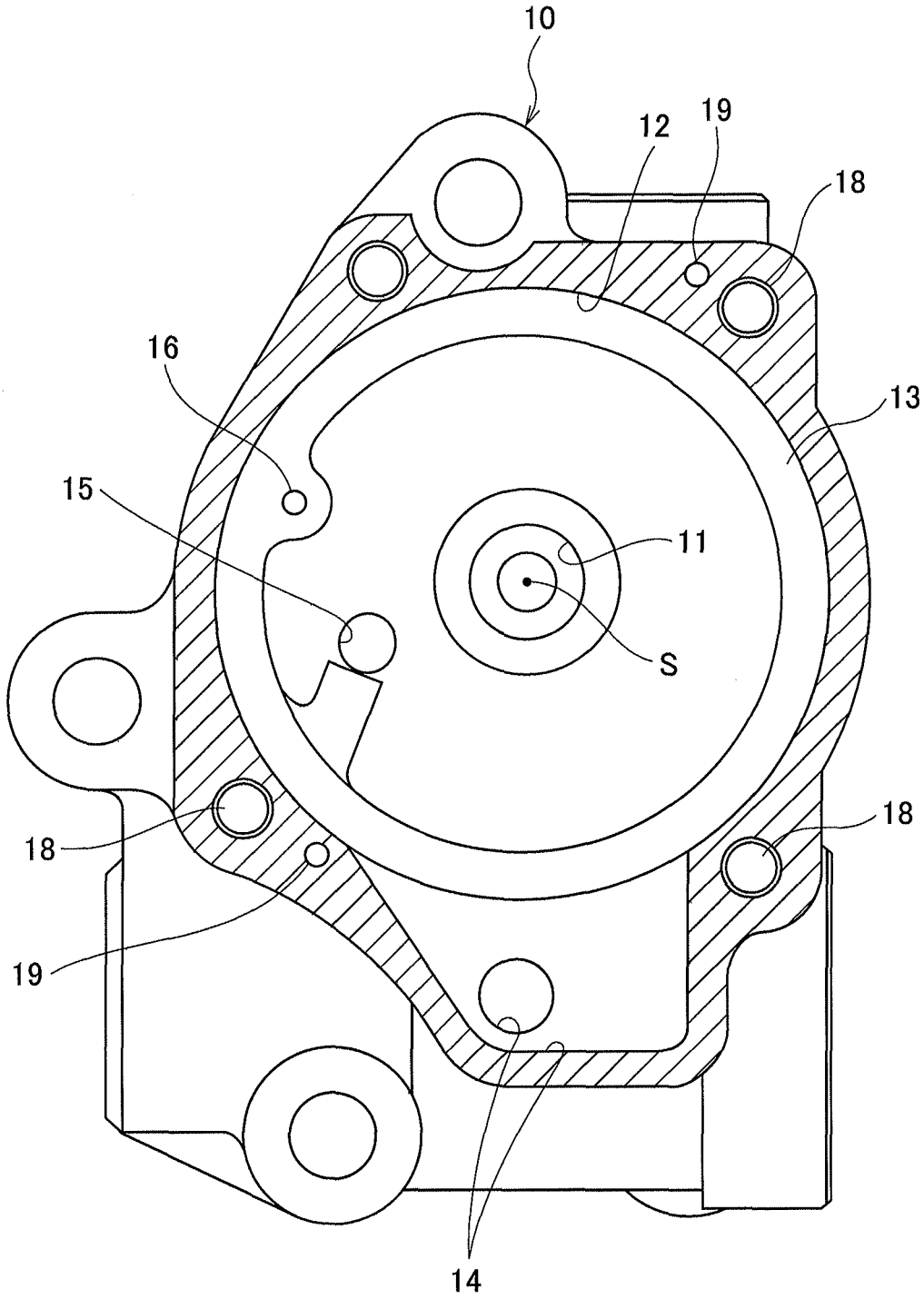
FIG. 3 is a front view illustrating a housing body which structures a part of the oil pump illustrated in FIG. 1.
Figure 4A:
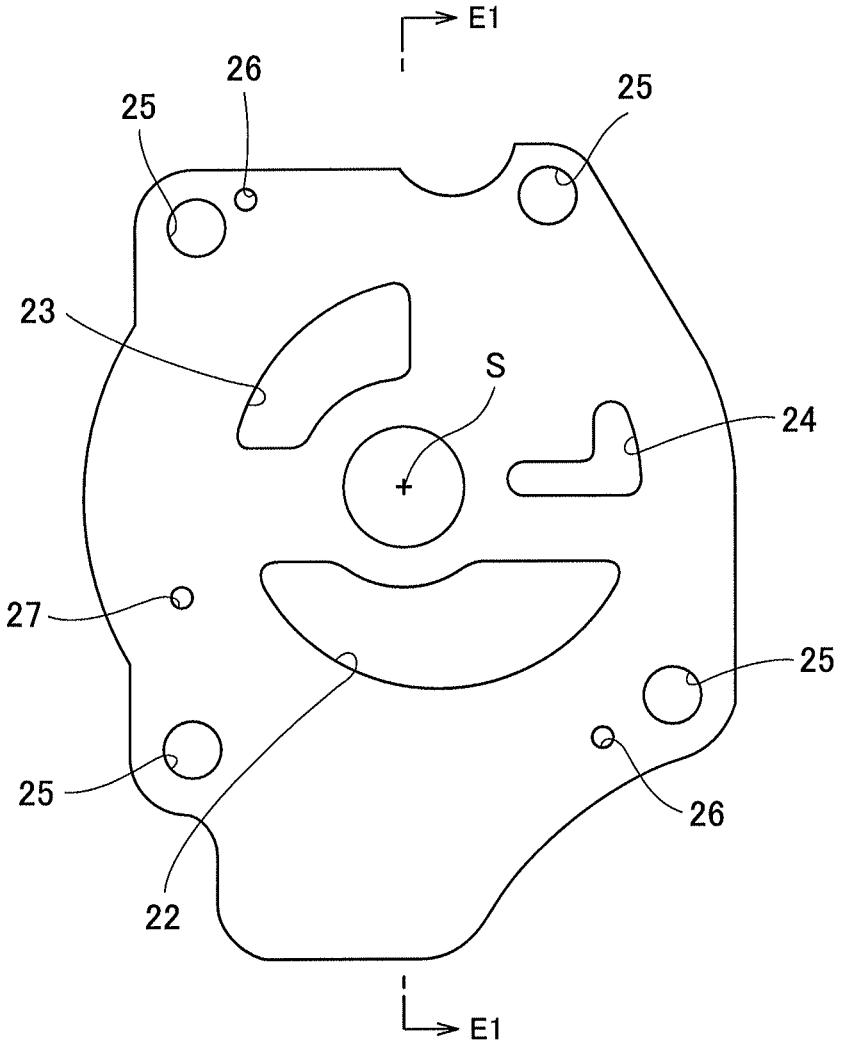
FIG. 4A is a plane view of a housing cover which structures a part of the oil pump illustrated in FIG. 1 viewed from the rear R side (inner surface side).
Figure 4B:
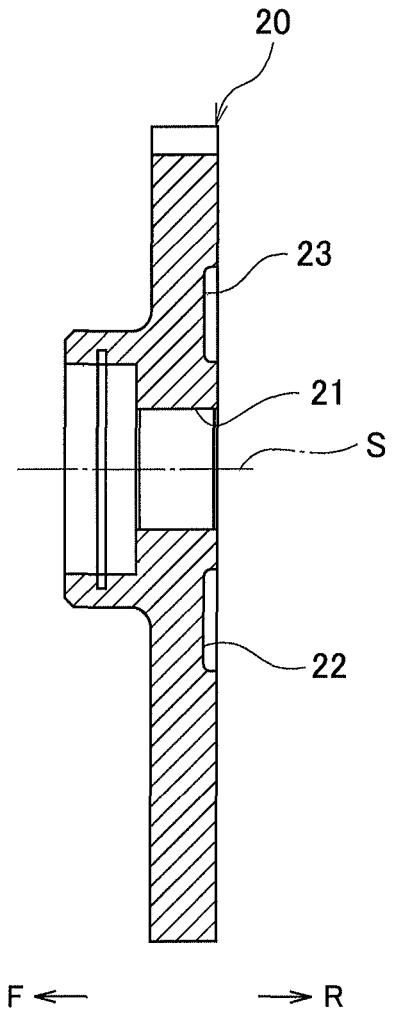
FIG. 4B is a sectional view of the housing cover which structures a part of the oil pump illustrated in FIG. 1 at E1-E1 in FIG. 4A.
Figure 5:
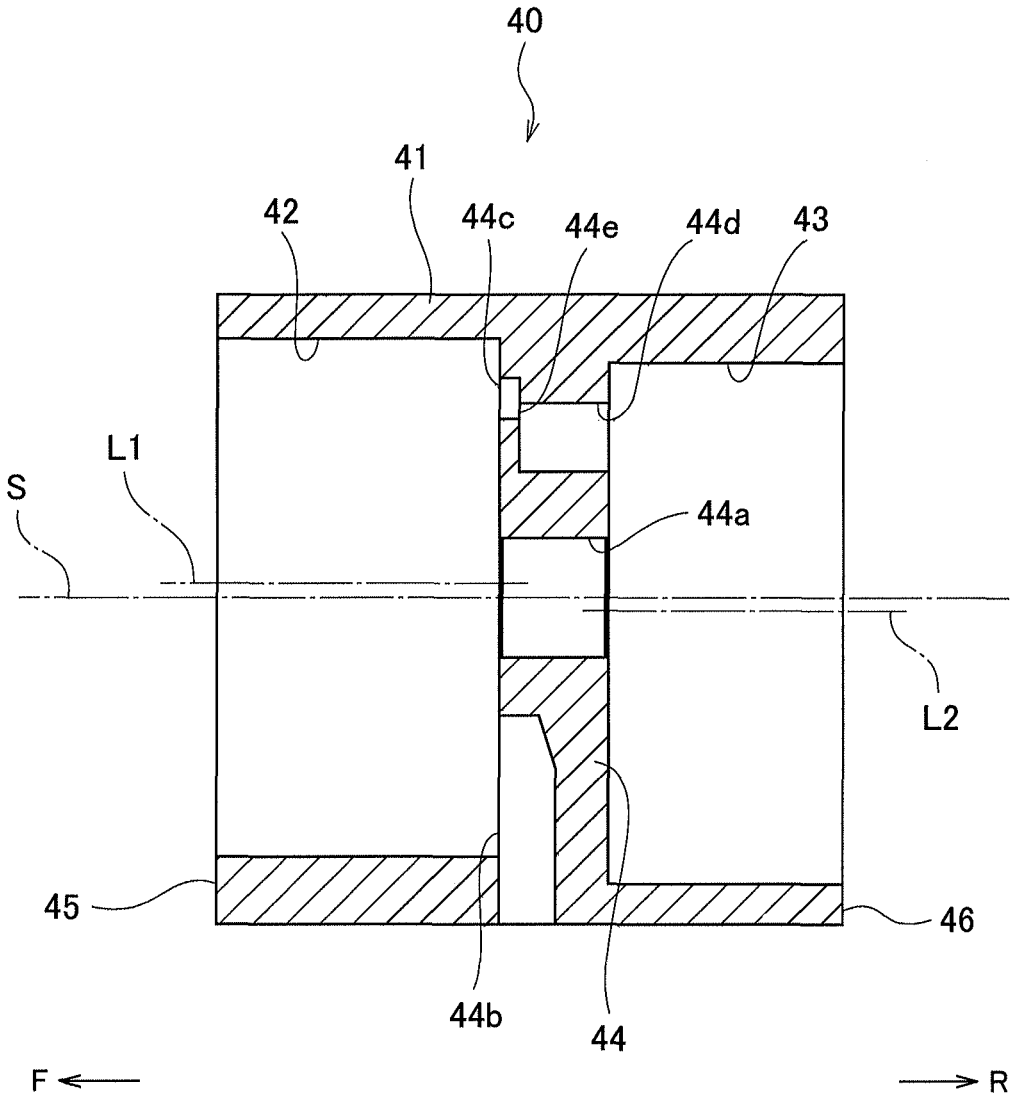
FIG. 5 is a sectional view illustrating a rotor case which structures a part of the oil pump illustrated in FIG. 1.
Figure 6A:
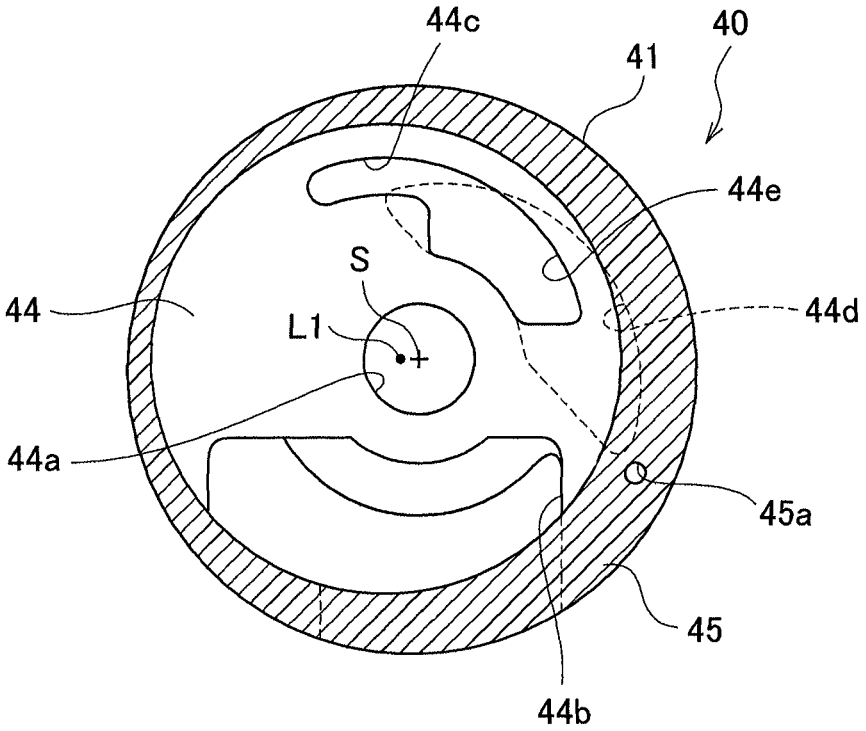
FIG. 6A is an end view of the rotor case illustrated in FIG. 5 viewed from the front F side.
Figure 6B:
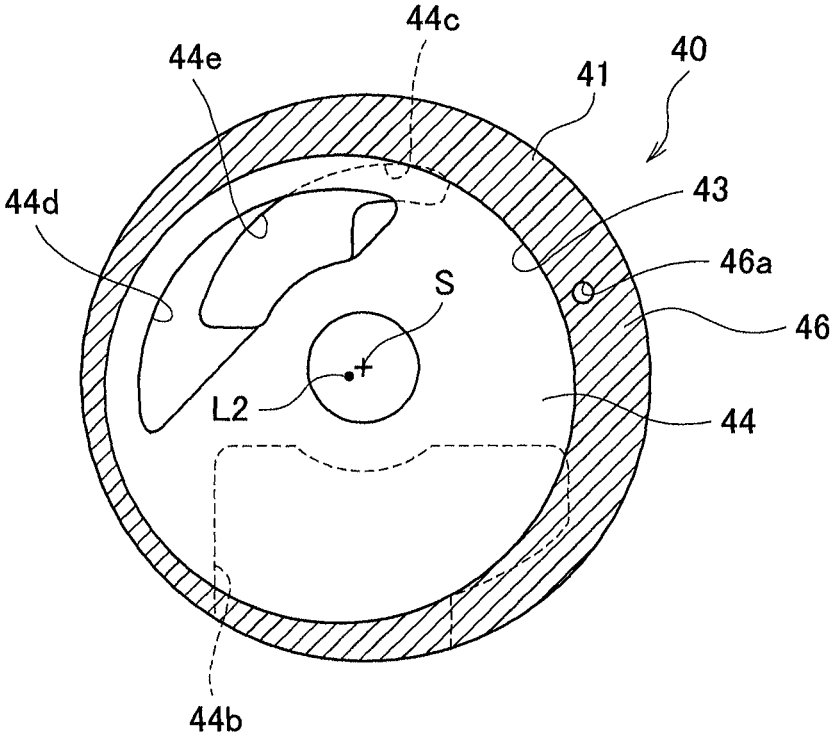
FIG. 6B is an end view of the rotor case illustrated in FIG. 5 viewed from the rear R side.

The housing body 10 made of aluminum or the like for weight saving and the like is configured to form a concave portion for containing the side plate 50 and the rotor case 40 which contains the upstream rotor 70 and the downstream rotor 80. As illustrated in FIGS. 2 and 3, the housing body 10 includes a bearing hole 11 for rotatably supporting one end portion 31 of the rotary shaft 30 via a bearing G, a cylindrical inner circumferential face 12 to which the rotor case 40 is fitted, an annular end face 13 which are formed to have a diameter lessened to form a stepped portion at a back side of the inner circumferential face 12, an inlet passage 14 through which oil is sucked as being formed by removing a part of the inner circumferential face 12 and drilling thereat outward in the radial direction, a discharge passage 15 through which pressurized oil is discharged as being formed at a bottom side, a positioning hole 16 for positioning the side plate 50, a joint face 17 for joining the housing cover 20, screw holes 18 into which bolts B are screwed for fastening the housing cover 20, positioning holes 19 for positioning the housing cover 20, and the like.

The housing cover 20 is made of aluminum material or the like being the same as the housing body 10 for weight saving and the like. As illustrated in FIGS. 1, 2, 4A, and 4B, the housing cover 20 includes a bearing hole 21 for rotatably supporting the other end portion 32 of the rotary shaft 30 via a bearing G, a concave portion 22 which is faced to an inlet port 44*b* in the direction of the axis line S, a concave portion 23 which is faced to a communication port 44*e* in the direction of the axis line S, an ejection port 24 through which air mixed with sucked oil (air-mixed oil) is ejected, circular holes 25 through which the bolts B pass, positioning holes 26 for positioning against the housing body 10, a positioning hole 27 for positioning the rotor case 40, and the like.

The housing cover 20 is joined to the joint face 17 to close an opening of the housing body 10 while a positioning pin fitted into the positioning hole 19 is fitted into the positioning hole 26 and a positioning pin fitted into a positioning hole 45*a* of the rotor case 40 is fitted into the positioning hole 27. Then, the housing cover 20 is connected to the housing body 10 by screwing the bolts B into the screw holes 18 as passing through the circular holes 25 from the outer side.

As described above, the housing is structured with the housing body. 10 and the housing cover 20. Accordingly, the entire assembling can be performed by only arranging the rotor case 40 which contains the upstream rotor 70 (the first inner rotor 71 and the second outer rotor 72) and the downstream rotor 80 (the second inner rotor 81 and the second outer rotor 82), the side plate 50, and the O-ring 60 in the housing body 10 and attaching the housing cover 20 thereonto. Thus, assembling operation can be easily performed.

As illustrated in FIG. 2, the rotary shaft 30 made of steel, sintered steel, iron, or the like is formed as being elongated in the direction of the axis line S. The rotary shaft 30 includes the one end portion 31 which is supported by the bearing hole 11 of the housing body 10 via the bearing G, the other end portion 32 which is supported by the bearing hole 21 of the housing cover 20 via the bearing G, a shaft portion 33 which integrally rotates the first inner rotor 71 of the upstream rotor 70, a shaft portion 34 which integrally rotates the second inner rotor 81 of the downstream rotor 80, a shaft potion 35 which is supported by a bearing hole 44*a* of the rotor case 40, and the like. The rotary shaft 30 is configured to be rotationally driven as being connected to a rotary member or the like which structures a part of an engine.

The rotor case 40 is made of steel, sintered steel, iron, or the like. As illustrated in FIGS. 2, 5, 6A, and 6B, the rotor case 40 includes a cylindrical portion 41 which is centered at the axis line S, an upstream accommodation portion 42 having an inner circumferential face centered at an axis line L1 which is shifted by a predetermined amount from the axis line S at the inner side of the cylindrical portion 41, a downstream accommodation portion 43 having an inner circumferential face centered at an axis line L2 which is shifted by a predetermined amount from the axis line S at the inner side of the cylindrical portion 41, a middle wall portion 44 which is formed between the upstream accommodation portion 42 and the downstream accommodation portion 43 in the direction of the axis line S, a bearing hole 44*a* arranged at the middle wall portion 44, an inlet port 44*b* which is arranged at the middle wall portion 44, an upstream rotor discharge port 44*c* which is arranged at the middle wall portion 44, a downstream rotor inlet port 44*d* which is arranged at the middle wall portion 44, the communication port 44*e* through which the upstream rotor discharge port 44*c* and the downstream rotor inlet port 44*d* are mutually connected, an annular end face 45 with which the housing cover 20 is in contact, a positioning hole 45*a* which is formed at the annular end face 45, an annular end face 46 with which the side plate 50 is in contact, a positioning hole 46*a* which is formed at the annular end face 46, and the like.

The cylindrical portion 41 is formed to have an outer diameter dimension so that the cylindrical portion 41 is fitted into the housing body 10 as being capable of relatively moving in the direction of the axis line S in accordance with difference between thermal deformation (expansion and contraction) amounts of the housing body 10 and the rotor case 40 while being intimately contacted to the inner circumferential face 12 of the housing body 10.

The upstream accommodation portion 42 is formed to have a dimension defining the inner circumferential face with which the first outer rotor 72 of the upstream rotor 70 is in contact rotatably (slidably) about the axis line L1.

The downstream accommodation portion 43 is formed to have a dimension defining the inner circumferential face with which the second outer rotor 82 of the downstream rotor 80 is in contact rotatably (slidably) about the axis line L2.

The inlet port 44*b* is formed so as to be faced to (a pump chamber P of) the upstream rotor 70 while communicating with the inlet passage 14.

The communication port 44*e* is configured to cause communication between the upstream rotor discharge port 44*c* and the downstream rotor inlet port 44*d* so that oil discharged from the upstream rotor 70 is introduced to the downstream rotor 80.

The rotor case 40 is assembled (fitted) to the inner circumferential face 12 of the housing body 10 in a state of containing the upstream rotor 70 in the upstream accommodation portion 42 and the downstream rotor 80 at the downstream accommodation portion 43 along with the rotary shaft 30 while the positioning pin fitted into the positioning hole 16 is fitted into the positioning hole 46*a* as sandwiching the O-ring 60 and the side plate 50 in cooperation with the end face 13.

Here, the upstream accommodation portion 42, the downstream accommodation portion 43, and the middle wall portion 44 are integrally formed in the rotor case 40. Accordingly parts count can be reduced and handling convenience can be improved.

Figure 7A:
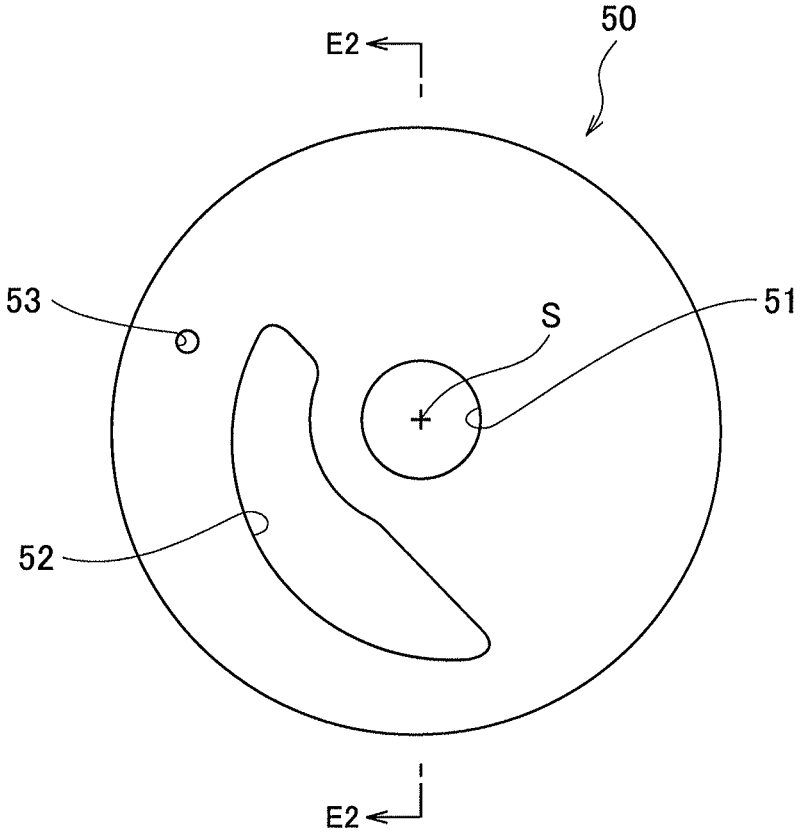
FIG. 7A is a plane view of a side plate which structures apart of the oil pump illustrated in FIG. 1 viewed from the front F side.
Figure 7B:
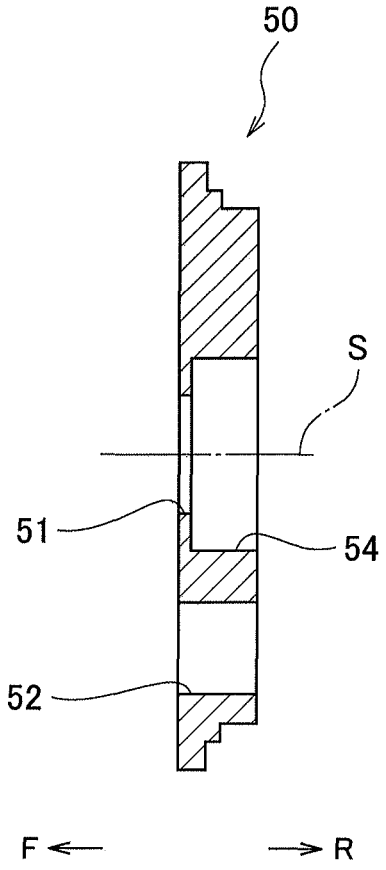
FIG. 7B is a sectional view of the side plate which structures a part of the oil pump illustrated in FIG. 1 at E2-E2 in FIG. 7A.

The side plate 50 is made of aluminum material or the like being the same as the housing (10, 20) for weight saving and the like. As illustrated in FIGS. 2, 7A, and 7B, the side plate 50 includes a circular hole 51 through which the rotary shaft 30 passes, a discharge port 52 through which oil pressurized by the downstream rotor 80 is discharged, a positioning hole 53, a concave portion 54 which receives a cylindrical portion defining the bearing hole 11, and the like.

The side plate 50 is configured to be assembled to the housing body 10 as sandwiching the O-ring 60 at a space against the end face 13 while a positioning pin fitted into the positioning hole 16 of the housing body 10 passes through the positioning hole 53.

The O-ring 60 is formed circularly as being made of elastically-deformable rubber material or the like and is arranged between the end face 13 of the housing body 10 and the side plate 50. The O-ring 60 is assembled as being compressed by a predetermined compression amount in the direction of the axis line S to urge the side plate 50 toward the annular end face 46 of the rotor case 40.

Figure 8A:
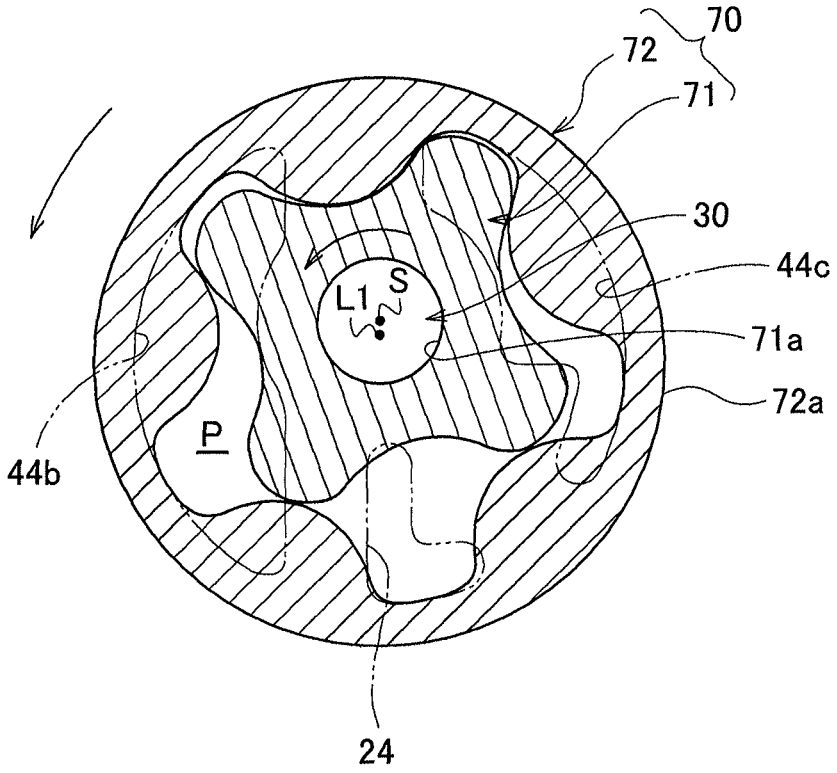
FIG. 8A is a plane view illustrating an inner rotor and an outer rotor structuring a part of the oil pump illustrated in FIG. 1 viewing an upstream rotor including a first inner rotor and a first outer rotor from the rear R side.

Similarly to the rotor case 40, the upstream rotor 70 is made of steel, sintered steel, iron, or the like. As illustrated in FIG. 8A, the upstream rotor 70 includes the first inner rotor 71 and the first outer rotor 72.

The first inner rotor 71 is formed as an external gear which has four crests and roots (cavities) while including a fitting hole 71*a* into which the shaft portion 33 of the rotary shaft 30 is fitted.

The first outer rotor 72 is formed as an internal gear which has five crests (inner teeth) and roots (cavities) to be engaged with the four crests (external teeth) and roots (cavities) of the first inner rotor 71 at the inner circumference thereof while including an outer circumferential face 72*a* which is slidably fitted to (the inner circumferential face of) the upstream accommodation portion 42 of the rotor case 40.

That is, the upstream rotor 70 (the first inner rotor 71 and the first outer rotor 72) is a trochoid pump having four blades and five nodes.

When the first inner rotor 71 is rotated along with the rotary shaft 30 in an arrow direction about the axis line S (counterclockwise in FIG. 8A), the first outer rotor 72 is coordinated and rotated in an arrow direction about the axis line L1 (counterclockwise in FIG. 8A). Accordingly, volume of the pump chamber P defined by both thereof is varied and oil is sucked through the inlet port 44*b* and compressed subsequently. Air-mixed oil is ejected through the ejection port 24 in the compression process, and subsequently, remaining oil is discharged through the upstream rotor discharge port 44*c* to the downstream rotor 80. Then, the above processes are to be continuously repeated.

Figure 8B:
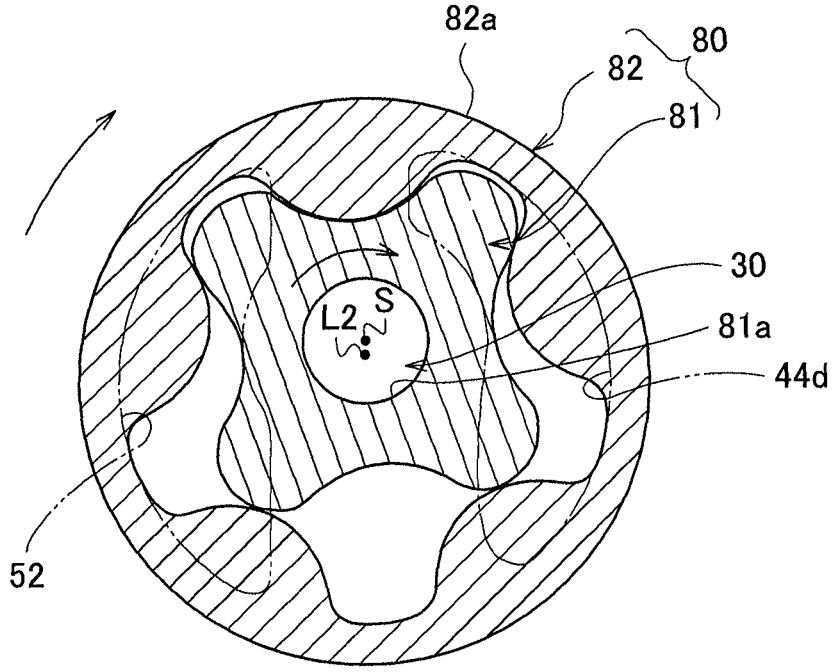
FIG. 8B is a plane view illustrating an inner rotor and an outer rotor structuring a part of the oil pump illustrated in FIG. 1 viewing a downstream rotor including a second inner rotor and a second outer rotor from the front F side.

Similarly to the rotor case 40, the downstream rotor 80 is made of steel, sintered steel, iron, or the like. As illustrated in FIG. 8B, the downstream rotor 80 includes the second inner rotor 81 and the second outer rotor 82.

The second inner rotor 81 is formed as an external gear which has four crests and roots (cavities) at the outer circumferential face thereof while including a fitting hole 81*a* into which the shaft portion 34 of the rotary shaft 30 is fitted.

The second outer rotor 82 is formed as an internal gear which has five crests (inner teeth) and roots (cavities) to be engaged with the four crests (external teeth) and roots (cavities) of the second inner rotor 81 at the inner circumference thereof while including an outer circumferential face 82*a* which is slidably fitted to (the inner circumferential face of) the downstream accommodation portion 43 of the rotor case 40.

That is, the downstream rotor 80 (the second inner rotor 81 and the second outer rotor 82) is a trochoid pump having four blades and five nodes.

When the second inner rotor 81 is rotated along with the rotary shaft 30 in an arrow direction (clockwise in FIG. 8B) about the axis line S, the second outer rotor 82 is coordinated and rotated in an arrow direction (clockwise in FIG. 8B) about the axis line L2. Accordingly, volume of the pump chamber P defined by both thereof is varied and oil is sucked through the downstream inlet port 44*d* and compressed subsequently. Then, oil is discharged through the discharge port 52 toward an external lubrication area. The above processes are to be repeated continuously.

As described above, the two-stage trochoid pump including the upstream rotor 70 and the downstream rotor 80 is adopted. Accordingly, while achieving downsizing in an outer diameter dimension of the apparatus, a desired discharged rate is ensured and enhanced pumping performance can be obtained as reducing a discharge resistance at high load, that is, as suppressing decrease in final discharge pressure.

In the abovementioned structure, the rotor case 40 is fitted into the housing (10, 20), the upstream rotor 70 (the first inner rotor 71 and the first outer rotor 72) and the downstream rotor 80 (the second inner rotor 81 and the second outer rotor 82) are arranged to be rotated in the rotor case 40, and the side plate 50 is in contact with the annular end face 46 at one side of the rotor case 40 as being urged by the O-ring (elastic member) 60 in the direction of the axis line S of the rotary shaft 30. Accordingly, for example, even in a case that the housing (10, 20) is thermally expanded, the rotor case 40 is continuously in a state of being sandwiched between the inner wall face of the housing (20) and the side plate 50 owing to the urging force of the O-ring 60.

Therefore, both side faces of the upstream rotor 70 (the first inner rotor 71 and the first outer rotor 72) and both side faces of the downstream rotor 80 (the second inner rotor 81 and the second outer rotor 82) which are contained in the rotor case 40 can maintain constant clearance (side clearance) enabling to be slid between the inner wall face of the housing (20) and the middle wall portion 44 and between the side plate 50 and the middle wall portion 44. In addition, oil leakage through the clearance can be prevented from occurring and stable volume efficiency (pumping performance) can be obtained. Further, the urging force of the O-ring 60 is not applied to both the side faces of the upstream rotor 70 (the first inner rotor 71 and the first outer rotor 72) and the downstream rotor 80 (the second inner rotor 81 and the second outer rotor 82). Accordingly, compared to a conventional oil pump, slide resistance and operational torque can be reduced and durability can be improved.

Further, the rotor case 40 is made of material having the same thermal expansion coefficient as that of the upstream rotor 70 (the first inner rotor 71 and the first outer rotor 72) and the downstream rotor 80 (the second inner rotor 81 and the second outer rotor 82). Therefore, even in a case that the housing (10, 20), the rotor case 40, the upstream rotor 70, and the downstream rotor 80 are deformed with thermal expansion and the like respectively, relative dimensional relations among the rotor case 40, the upstream rotor 70, and the downstream rotor 80 can be maintained at constant. That is, the side clearance can be maintained at constant. Accordingly, it is possible to maintain desired pumping performance more reliably without being influenced by thermal expansion and the like.

Further, since the side plate 50 is made of material having the same thermal expansion coefficient as that of the housing (10, 20), the housing (10, 20) and the side plate 50 can be reduced in weight as being made of light-weight material or the like. In addition, even when the same thermal deformation (thermal expansion) occurs at the side plate 50 and the housing (10, 20), contact relations among both the side faces of the upstream rotor 70 and the downstream rotor 80, the inner wall face of the housing (20), and the side plate 50 can be maintained in a desired state owing to that the side plate 50 is urged by the O-ring 60 in the direction of the axis line S. Accordingly, it is possible to maintain desired pumping performance.

In particular, dimensional relations among the rotor case 40, the upstream rotor 70 (the first inner rotor 71 and the first outer rotor 72), and the downstream rotor 80 (the second inner rotor 81 and the second outer rotor 82) are arranged to satisfy "Wc>Wr" while Wc denotes a width dimension of the rotor case 40 in the direction of the axis line S of the rotary shaft 30 and Wr denotes a width dimension of the upstream rotor 70 and the downstream rotor 80 in the direction of the axis line S of the rotary shaft 30.

According to the above, both the side faces of the upstream rotor 70 (the first inner rotor 71 and the first outer rotor 72) and the downstream rotor 80 (the second inner rotor 81 and the second outer rotor 82) are maintained as being faced to the inner wall face of the housing (20) and the side plate 50 with constant clearance ΔC (=Wc−Wr) formed therebetween in a state of not being protruded from both ends (the annular end faces 45, 46 at both sides) of the rotor case 40 in the direction of the axis line S. Accordingly, it is possible to ensure desired pumping performance while further reducing slide resistance.

Next, operation of the oil pump will be described with reference to FIGS. 8A and 8B.

First, when the rotary shaft 30 is rotationally driven by an engine, the upstream rotor 70 (the first inner rotor 71 and the first outer rotor 72) is rotated counterclockwise in FIG. 8A and oil is sucked into the pump chamber P through the inlet passage 14 and the inlet port 44*b*.

Then, owing to continuous rotation of the upstream rotor 70, the oil sucked into the pump chamber P is pressurized. In the pressurization process, air-mixed oil is forcedly ejected outside through the ejection port 24. Further, the remaining oil is introduced to the downstream rotor 80 through the upstream rotor discharge port 44*c*, the communication port 44*e*, and the downstream rotor inlet port 44*d*.

Subsequently, the oil is sucked into the pump chamber P of the downstream rotor 80 through the downstream rotor inlet port 44*d* with clockwise rotation in FIG. 8B of the downstream rotor 80 (the second inner rotor 81 and the second outer rotor 82).

Owing to continuous rotation of the downstream rotor 80, the oil sucked into the pump chamber P is pressurized and supplied to an external lubrication area through the discharge port 52 and the discharge passage Practically, cooperative action of the upstream rotor 70 (the first inner rotor 71 and the first outer rotor 72) and the downstream rotor 80 (the second inner rotor 81 and the second outer rotor 82) causes the respective pump chambers to continuously perform sucking of oil, pressurizing of oil, ejecting of mixed air (air-mixed oil), and discharging of oil.

Here, even in a case that the housing (10, 20) is thermally expanded, the rotor case 40 is continuously in a state of being sandwiched between the inner wall face of the housing (20) and the side plate 50 owing to the urging force of the O-ring 60. Therefore, both the side faces of the upstream rotor 70 and the downstream rotor 80 contained in the rotor case 40 can maintain constant clearance (side clearance) enabling to be slid between the inner wall face of the housing (20) and the side plate 50. In addition, oil leakage through the clearance can be prevented from occurring and stable volume efficiency (pumping performance) can be obtained. Further, the urging force of the O-ring 60 is not applied to both the side faces of the upstream rotor 70 and the downstream rotor 80. Accordingly, compared to a conventional oil pump, slide resistance and operational torque can be reduced and durability can be improved.

Another embodiment of an oil pump according to the present invention is illustrated in FIGS. 9 to 12A and 12B. This embodiment is the same as the abovementioned embodiment aside from modification of a rotor case, a side plate, and a housing cover. Here, the same reference is given to the same element and description thereof will be skipped.

Figure 9:
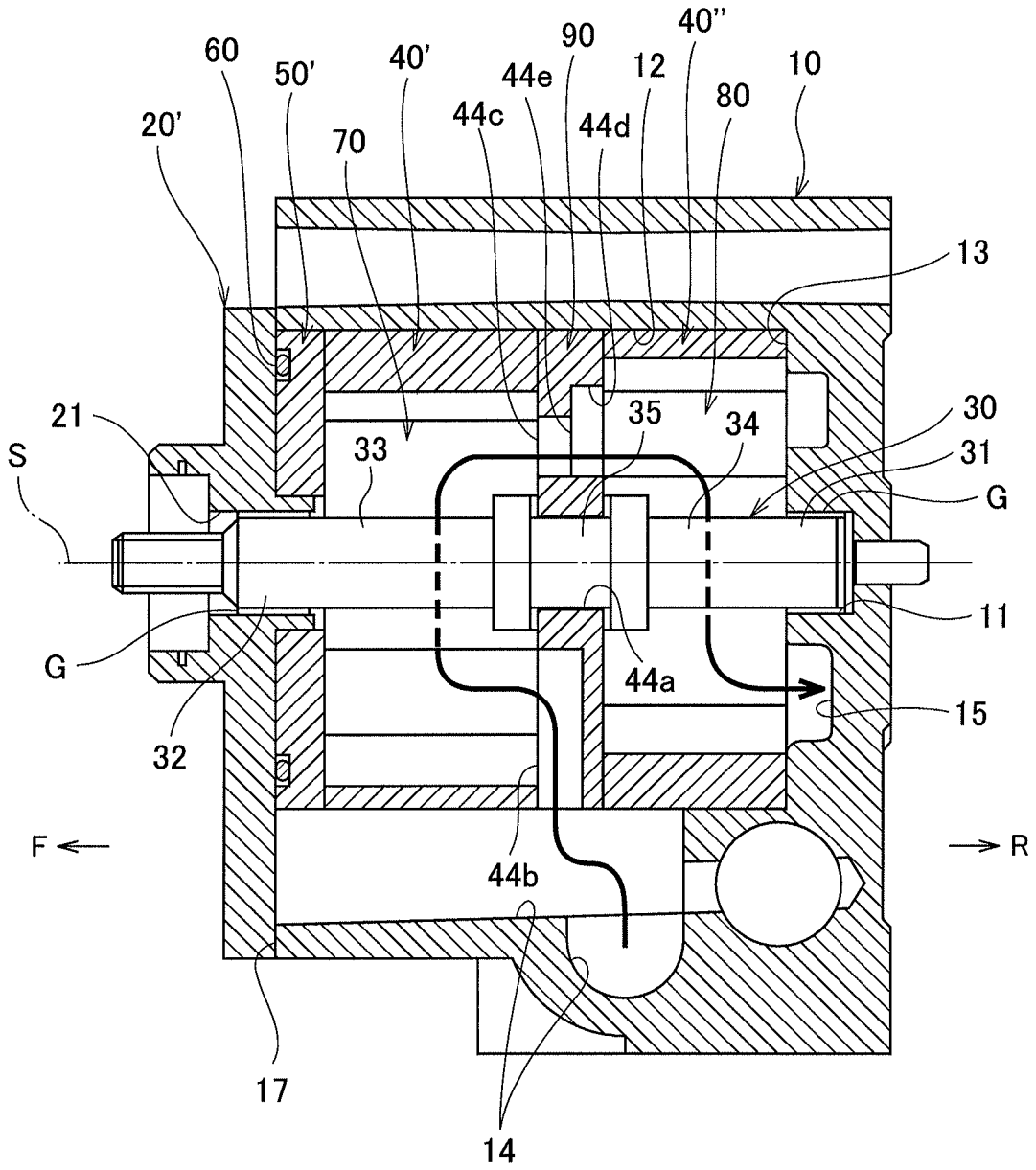
FIG. 9 is a sectional view of the inside of another embodiment of an oil pump according to the present invention.
Figure 10:
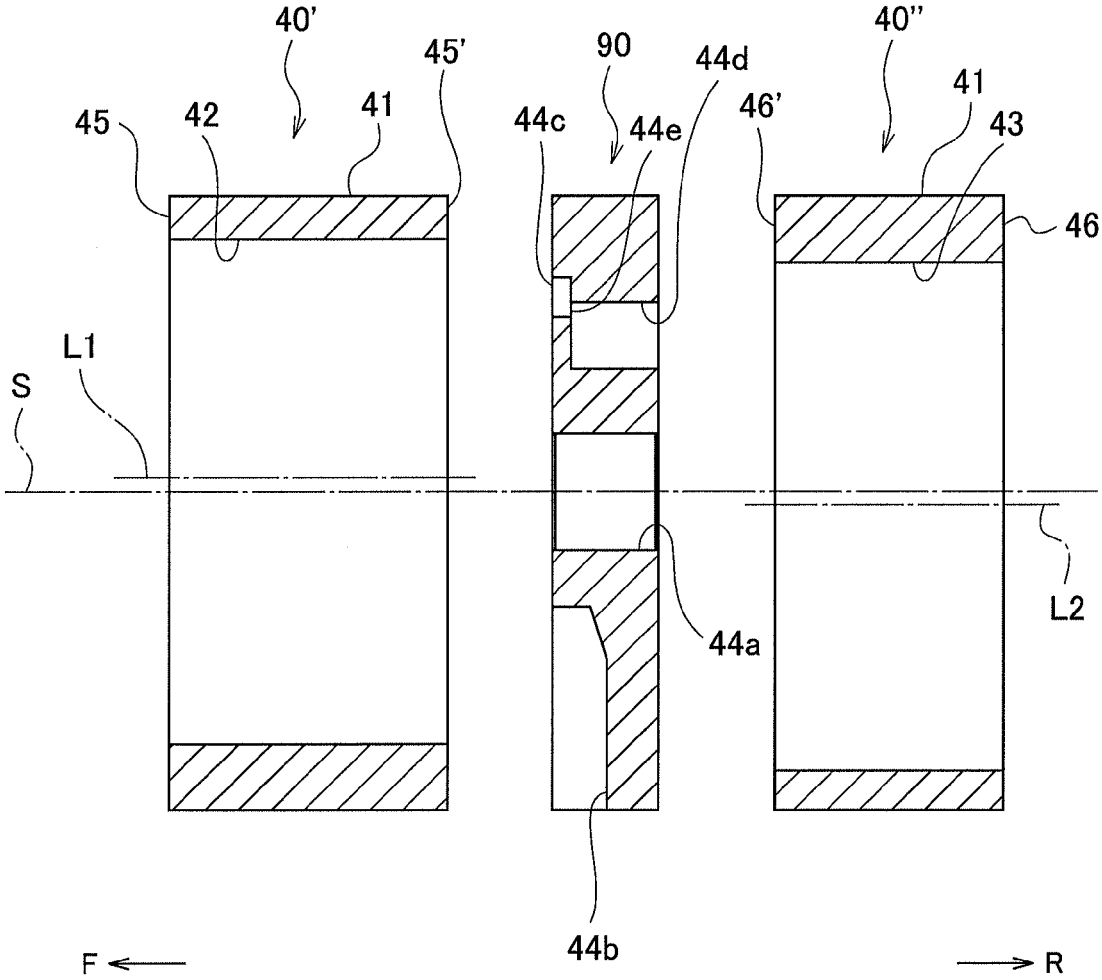
FIG. 10 is an exploded sectional view illustrating a rotor case (an upstream rotor case, a downstream rotor case) and a spacer member which structure a part of the oil pump illustrated in FIG. 9.

In this embodiment, as illustrated in FIGS. 9 and 10, the rotor case is structured with an upstream rotor case 40' and a downstream rotor case 40" and a spacer member 90 is arranged therebetween.

Further, a side plate 50' is arranged to be in contact with a housing cover 20' and the O-ring 60 is arranged as the elastic member between the housing cover 20' and the side plate 50'.

The upstream rotor case 40' is made of steel, sintered steel, iron, or the like. As illustrated in FIG. 10, the upstream rotor case 40' includes a cylindrical portion 41 which is centered at the axis line S, the upstream accommodation portion 42 having an inner circumferential face which is centered at the axis line L1 shifted by a predetermined amount from the axis line S at the inner side of the cylindrical portion 41 and with which the first outer rotor 72 of the upstream rotor 70 is in contact rotatably (slidably) about the axis line L1, the annular end face 45 with which the side plate 50' is in contact, an annular end face 45' with which the spacer member 90 is in contact, and the like.

A positioning hole into which a positioning pin is fitted for positioning against the spacer member 90 is formed at the annular end face 45'.

As illustrated in FIG. 9, the upstream rotor case 40' is formed to contain and hold the upstream rotor 70 as preventing both the side faces of the first inner rotor 71 and the second outer rotor 72 from being protruded in the direction of the axis line S.

The downstream rotor case 40" is made of steel, sintered steel, iron, or the like. As illustrated in FIG. 10, the downstream rotor case 40" includes a cylindrical portion 41 which is centered at the axis line S, the downstream accommodation portion 43 having an inner circumferential face which is centered at the axis line L2 shifted by a predetermined amount from the axis line S at the inner side of the cylindrical portion 41 and with which the second outer rotor 82 of the downstream rotor 80 is in contact rotatably (slidably) about the axis line L2, the annular end face 46 with which the end face 13 of the housing body 10 is in contact, an annular end face 46' with which the spacer member 90 is in contact, and the like.

A positioning hole into which a positioning pin is fitted for positioning against the spacer member 90 is formed at the annular end face 46'.

As illustrated in FIG. 9, the downstream rotor case 40" is formed to contain and hold the downstream rotor 80 as preventing both the side faces of the second inner rotor 81 and the second outer rotor 82 from being protruded in the direction of the axis line S.

The spacer member 90 is made of aluminum material or the like being the same as the housing (10, 20) for weight saving and the like. The spacer member 90 includes the bearing hole 44*a*, the inlet port 44*b*, the upstream rotor discharge port 44*c*, the downstream rotor inlet port 44*d*, the communication port 44*e* for communication, a positioning hole into which a positioning pin is fitted for positioning between the upstream rotor case 40' and the downstream rotor case 40", and the like.

Figure 11A:
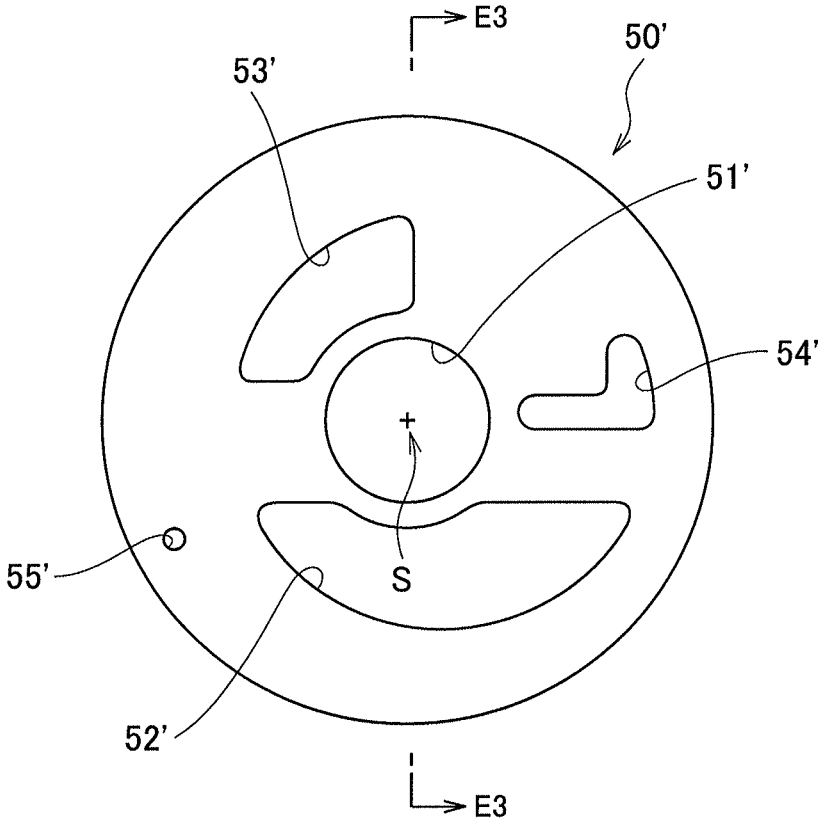
FIG. 11A is a plane view of a side plate which structures a part of the oil pump illustrated in FIG. 9 viewed from the rear R side.
Figure 11B:
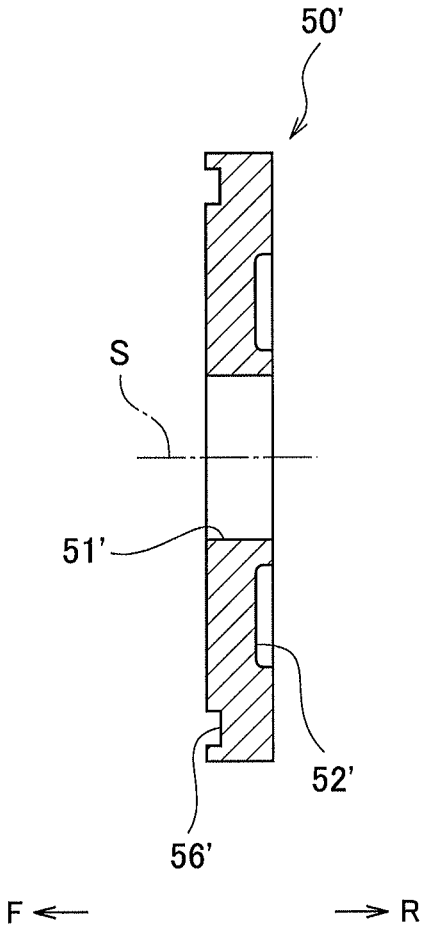
FIG. 11B is a sectional view of the side plate which structures a part of the oil pump illustrated in FIG. 9 at E3-E3 in FIG. 11A.

The side plate 50' is made of aluminum material or the like being the same as the housing (10, 20) for weight saving and the like. As illustrated in FIGS. 11A and 11B, the side plate 50' includes a circular hole 51' through which the rotary shaft 30 passes, a concave portion 52' which is faced to the inlet port 44*b* in the direction of the axis line S, a concave portion 53' which is faced to the communication port 44*e* in the direction of the axis line S, an ejection port 54' through which air mixed with sucked oil (air-mixed oil) is ejected, a positioning hole 55' for positioning between the housing cover 20' and the upstream rotor case 40', an annular concave portion 56' which contains a part of the O-ring 60, and the like.

Figure 12A:
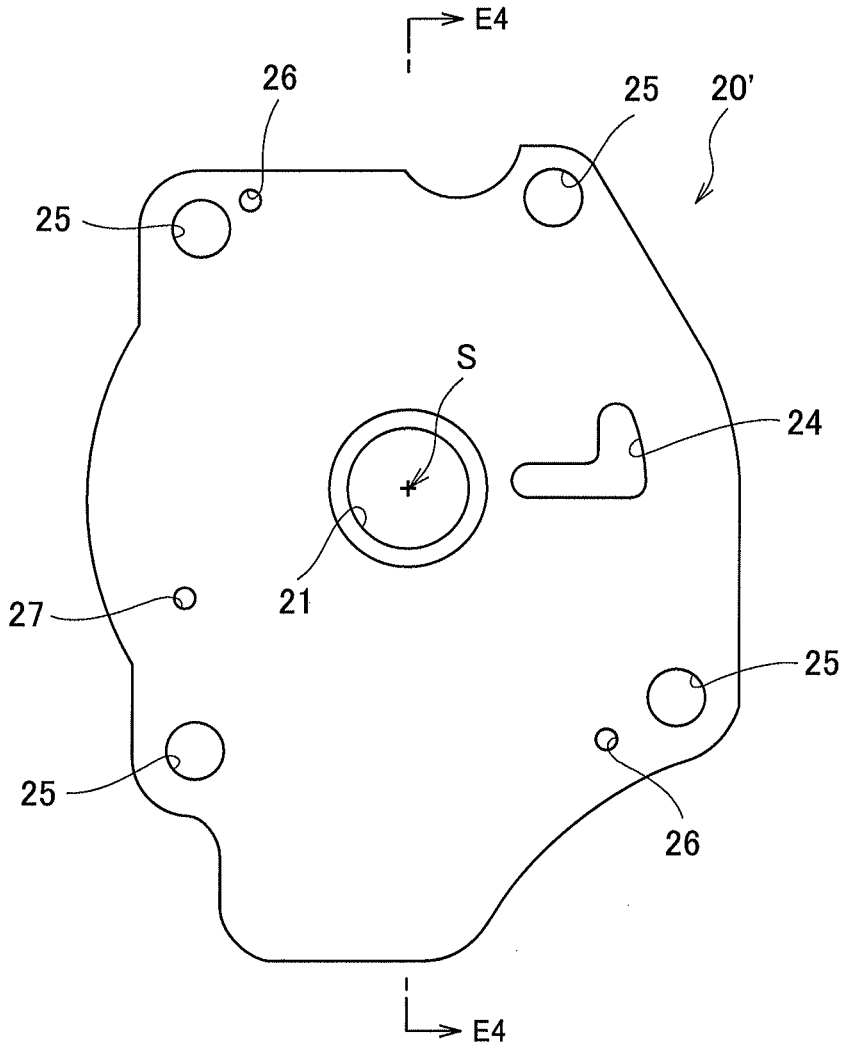
FIG. 12A is a plane view of a housing cover which structures a part of the oil pump illustrated in FIG. 9 viewed from the rear R side (inner face side).
Figure 12B:
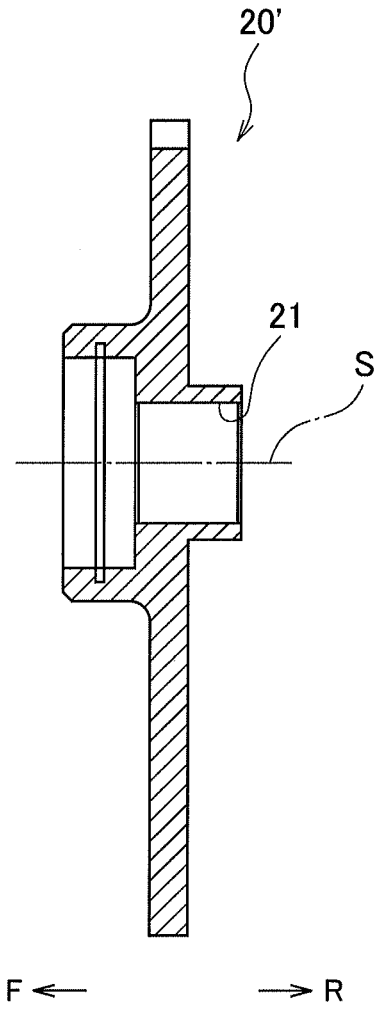
FIG. 12B is a sectional view of the housing cover which structures a part of the oil pump illustrated in FIG. 9 at E4-E4 in FIG. 12A.

The housing cover 20' is made of aluminum material or the like being the same as the housing (10, 20) for weight saving and the like. As illustrated in FIGS. 9, 12A, and 12B, the housing cover 20' includes the bearing hole 21, the ejection port 24 through which air mixed with sucked oil (air-mixed oil) is ejected, the circular holes 25 through which the bolts B pass, the positioning holes 26 for positioning against the housing cover 10, a positioning hole 27' for positioning the side plate 50', and the like.

The present embodiment also provides a two-stage trochoid pump in which the upstream rotor 70 is arranged in the upstream rotor case 40', the downstream rotor 80 is arranged in the downstream rotor case 40", and the spacer member 90 defines a space between the upstream rotor 70 and the downstream rotor 80. Accordingly, as described above, while maintaining clearance (side clearance) at constant in the direction of the axis line S, a desired discharge rate is ensured and enhanced pumping performance can be obtained as reducing a discharge resistance at high load, that is, as suppressing decrease in final discharge pressure.

In particular, since the rotor case includes the upstream rotor case 40' and the downstream rotor case 40" and the separated spacer member 90 is interposed therebetween, clearance at both side faces of the upstream rotor 70 and clearance at both side faces of the downstream rotor 80 can be maintained at constant independently with a high degree of accuracy.

Further, since the spacer member 90 is made of material having the same thermal expansion coefficient as that of the housing (10, 20'), the spacer member 90 is sandwiched between the upstream rotor case 40' and the downstream rotor case 40" via the elastically-urged side plate 50' and the inner wall face of the housing (10) even when the same thermal deformation (thermal expansion) occurs at the spacer member 90 and, the housing (10, 20'). Accordingly, contact relations among both the side faces of the upstream rotor 70 and the downstream rotor 80, the inner wall face of the housing (10), the spacer member 90, and the side plate 50' can be maintained in a desired state. In particular, when the housing (10, 20') and the spacer member 90 are made of light weight material or the like, desired pumping performance can be maintained while achieving reduction in weight.

In the description of the above embodiments, the present invention is applied to the two-stage trochoid pump which includes the upstream rotor 70 (the first inner rotor 71 and the first outer rotor 72) and the downstream rotor 80 (the second inner rotor 81 and the second outer rotor 82). However, not limited to the above, the present invention may be applied to a structure including one pair of an inner rotor and an outer rotor.

In the description of the above embodiments, the present invention is applied to a structure in which the housing is separated into the housing body and the housing cover. However, not limited to the above, the present invention may be applied to a structure in which a dual partitioning housing includes a first housing half body and a second housing half body which define a concave portion respectively.

In the description of the above embodiments, the oil pump is a trochoid pump. However, not limited to the above, the present invention may be adopted to an internal gear type oil pump, an external gear type oil pump, or the like.

INDUSTRIAL APPLICABILITY

As described above, according to the oil pump of the present invention, while achieving reduction of slide resistance, reduction of operational torque, suppression of deterioration with time, and the like, volume efficiency (pumping performance) can be stabilized and durability can be improved as preventing variation of side clearance at both the side faces of the inner rotor and the outer rotor. Accordingly, in addition to be naturally adopted to an engine which is mounted on an automobile or the like, an oil pump of the present invention is useful for motorcycles, other vehicles having an engine mounted, other mechanisms requiring pressured feeding of lubricant oil, and the like.

EXPLANATION OF REFERENCES

10 Housing body (Housing)
11 Bearing hole
12 Inner circumferential face
13 End face
14 Inlet passage
15 Discharge passage
16 Positioning hole
17 Joint face
18 Screw hole
19 Positioning hole
20, 20' Housing cover (Housing)
21 Bearing hole
22 Concave portion
23 Concave portion
24 Ejection port
25 Circular hole
26 Positioning hole
27, 27' Positioning hole
30 Rotary shaft
S Axis line
31 One end portion
32 Other end portion
33, 34, 35 Shaft portion
40 Rotor case
40' Upstream rotor case
40" Downstream rotor case
41 Cylindrical portion
42 Upstream accommodation portion
43 Downstream accommodation portion
44 Middle wall portion
44*a* Bearing hole
44*b* Inlet port
44*c* Upstream rotor discharge port
44*d* Downstream rotor inlet port
44*e* Communication port
45 Annular end face
45*a* Positioning hole
46 Annular end face
46*a* Positioning hole
50, 50' Side plate
51, 51' Circular hole
52 Discharge port
52' Concave portion
53 Positioning hole
53' Concave portion
54 Concave portion
54' Ejection port
55' Positioning hole
56' Annular concave portion
60 O-ring (Elastic member)
70 Upstream rotor
P Pump chamber
71 First inner rotor
71*a* Fitting hole
72 First outer rotor
L1 Axis line
72*a* Outer circumferential face
80 Downstream rotor
P Pump chamber
81 Second inner rotor
81*a* Fitting hole
82 Second outer rotor
L2 Axis line
82*a* Outer circumferential face
90 Spacer member

The invention claimed is:

1. An oil pump, comprising:
a housing;
a rotary shaft which is supported by the housing;
an inner rotor which is rotated in the housing integrally with the rotary shaft;
an outer rotor which is rotated in the housing as being interlocked with the inner rotor;
a rotor case which is fitted into the housing and which contains the inner rotor and the outer rotor and supports an outer circumferential face of the outer rotor in a slidable manner;
a side plate which is arranged to be in contact with at least one annular end face of the rotor case; and
an elastic member which exerts an urging force to press the side plate to the annular end face of the rotor case,
wherein the housing includes a housing body which has a concave portion to contain the rotor case and the side plate, and a housing cover which is coupled to close an opening of the housing body.

2. The oil pump according to claim 1, wherein the rotor case is made of material having the same thermal expansion coefficient as that of the inner rotor and the outer rotor.

3. The oil pump according to claim 2, wherein the side plate is made of material having the same thermal expansion coefficient as that of the housing.

4. The oil pump according to claim 1, wherein "Wc>Wr" is satisfied while Wc denotes a width dimension of the rotor case in the axis line direction of the rotary shaft and Wr denotes a width dimension of the inner rotor and the outer rotor in the axis line direction of the rotary shaft.

5. The oil pump according to claim 1,
wherein the inner rotor and the outer rotor include an upstream rotor including a first inner rotor and a first outer rotor and a downstream rotor including a second inner rotor and a second outer rotor, the upstream rotor and the downstream rotor being arranged adjacently in the axis line direction of the rotary shaft, and
the rotor case includes an upstream accommodation portion which contains the upstream rotor, a downstream accommodation portion which contains the downstream rotor, and a middle wall portion which is interposed between the upstream accommodation portion and the downstream accommodation portion.

6. The oil pump according to claim 1,
wherein the inner rotor and the outer rotor include an upstream rotor including a first inner rotor and a first outer rotor and a downstream rotor including a second inner rotor and a second outer rotor, the upstream rotor and the downstream rotor being arranged adjacently in the axis line direction of the rotary shaft,
the rotor case includes an upstream rotor case which contains the upstream rotor and a downstream rotor case which contains the downstream rotor, and
a spacer member is arranged between the upstream rotor case and the downstream rotor case.

7. The oil pump according to claim 6, wherein the spacer member is made of material having the same thermal expansion coefficient as that of the housing.

* * * * *